United States Patent [19]

Jaenson

[11] Patent Number: 4,515,004

[45] Date of Patent: May 7, 1985

[54] WELDED WIRE FABRIC BENDING APPARATUS AND METHOD

[75] Inventor: Howard W. Jaenson, Irwindale, Calif.

[73] Assignee: Jenglo Engineering, Inc., Azusa, Calif.

[21] Appl. No.: 433,360

[22] Filed: Oct. 7, 1982

[51] Int. Cl.[3] ..... B21D 9/05

[52] U.S. Cl. ..... 72/388; 140/107

[58] Field of Search ..... 72/388, 187, 188, 319, 72/21; 140/107

[56] References Cited

U.S. PATENT DOCUMENTS 3,774,434 11/1973 Bock ..... 140/107

3,867,829 2/1975 Bock ..... 72/388

FOREIGN PATENT DOCUMENTS 513775 7/1976 U.S.S.R. ..... 140/107

OTHER PUBLICATIONS

Brochure distributed by Brush Machine, Inc. of Portland, Oregon.

*Primary Examiner*—Francis S. Husar

*Assistant Examiner*—Linda McLaughlin

*Attorney, Agent, or Firm*—Christie, Parker & Hale

[57] ABSTRACT

An apparatus is provided for bending a welded wire fabric into a desired shape for use in reinforcing concrete. The apparatus includes an elongated frame and a plurality of anvils mounted on the frame around which the wires of the fabric are to be bent. The frame is divided into right-hand and left-hand sides along its length by a vertical plane passing the anvil axes. A first forming bar is on the right-hand side of the plane along the length of the frame. The first forming bar is mounted to pivot with respect to the anvils about a point on the left-hand side of the plane. A second forming bar is on the left-hand side of the plane along the length of the frame. The second forming bar is mounted to pivot with respect to the anvils about a point on the right-hand side of the plane. Means are provided for pivoting each forming bar to bring it into contact with the wires to be bent and for bending the wires around the anvils.

2 Claims, 18 Drawing Figures

+15 V.D.C.
A
SHAFT
ENCODER
270
268

-15 V.D.C.
Z
#1
#2
282
284
286
278
288
280
291
COUNTER
274
502
504
SHAFT
ENCODER
272
382
384
386
279
290
281
292
COUNTER
276
508
510
512

162
156
176

186
182
154a
154b
180
174
190
173
188
184
166
168
170
172
178

202
206
204
210
212
208
214
218
220
216
CRP
222
222
224
230
228
PUSH PULL SWITCH
232
240
234
236
238
242
OFF
ON
A
+15
-15
Z
TO FIG 14
264
262
266
330
OFF
ON
244
246
248
M
249
247
CRL
406
311
CRR
504
506
FLOW CONTROL VALVE
254
174
306
502
288
291
253
MAN
AUTO
JOYSTICK
252
250
251
256
260
258
R
327
300
238
FOOT SWITCH
RIGHT
302
303
CRR
304
236
CRR
310
308
CRL
508
510
512
FLOW CONTROL VALVE
176
354
408
290
292
353
MAN
AUTO
JOYSTICK
352
350
351
356
360
358
R
328
400
FOOT SWITCH
LEFT
402
403
CRL
404
320
R
328
RETURN
324
326
322

WELDED WIRE FABRIC BENDING APPARATUS AND METHOD

FIELD OF THE INVENTION

This invention relates to an apparatus and method for bending welded wire fabric into a desired shape for use in reinforcing concrete.

BACKGROUND OF THE INVENTION

For over 100 years steel has been used to reinforce concrete structures. The steel can, for example, be provided in the form of cylindrical bars called "rebars" that are placed in a form prior to pouring concrete. Depending on the configuration of the structure being formed, such rebars can be bent into shape as necessary, one by one, and then tied together to form a steel skeleton or cage around which the concrete agglomerates.

Bending rebars individually, and then tying them in position on a steel skeleton, is time-consuming and requires a significant amount of labor and, thus, is expensive.

As an alternative to using individual rebars for forming steel reinforcing skeletons, welded wire fabric can be used. Welded wire fabric is a prefabricated reinforcement consisting of a series of longitudinal steel wires welded at selected intervals to transverse steel wires. Commonly, the size of the wires used can range from as small as about 0.1 inch in diameter to as large as about 0.6 inch or larger.

When first constructed, welded wire fabric is flat. Reinforcing skeletons of desired shape are formed by bending the transverse wires of the fabric to selected angles. Welded wire fabric as long as 20–21 feet (longitudinal wire length) having almost any width (transverse wire length) is commonly used.

Referring to FIG. 1, one example of a welded wire fabric 10 is shown in its flat configuration. The fabric 10 is made up of a plurality of transverse wires 12 welded to a plurality of longitudinal wires 14. Both wire size and spacing between adjacent wires are determined by construction design considerations. It is not uncommon to have spacing between adjacent longitudinal and adjacent transverse wires that is nonuniform. For example, although spacing between adjacent longitudinal wires 14 of the fabric 10 is uniform, spacing between the transverse wires 12 is not.

In the past, welded wire fabric bending machines have been provided to bend wire fabrics, such as the wire fabric 10, into a shaped skeleton of a desired configuration. For example, FIG. 2 shows an end view of the fabric 10 after it has been bent into an elongated U-shaped cage 16 for use in reinforcing a column. In this example, the transverse wires 12 are bent 90° in the corners 18 of the U and are bent 135° at their ends to form two opposed hooks or tails 20. When the U-shaped cage is in place, rebars 22 can be positioned along the length of the cage in both of the corners 18 and in both hooks 20 for additional reinforcement.

Referring to FIG. 3, a schematic, fragmentary elevation view of a typical prior art wire bending apparatus 24 useful for bending welded wire fabric into a desired shape, such as the U-shaped cage 16, is shown. The apparatus 24 has an elongated frame 26 extending along its length with an elongated track 28 mounted on top of the frame. A plurality of anvils 30 (only one of which is shown) are mounted on the track around which the transverse wires 12 of the mesh 10 are bent. Each anvil is on a carrier 32 having a rectangular cutout portion 34 that engages the track. The carriers can be moved along the length of the track and then fixed in desired positions, depending on the configuration of the wire to be bent.

A forming bar 36 extending along the length of the frame 26 is provided for bending the wires. The forming bar is connected to several arms 37 (only one of which is shown) that are pivotally mounted to the frame on the same side of the frame as the forming bar. Means, such as hydraulic rams 38, are provided to move the arms and forming bar to bend the wire fabric.

When using the apparatus 24 for bending a wire fabric, the fabric is placed on the apparatus with each transverse wire 12 extending under an associated anvil 30, i.e., between the bottom of the anvil and its carrier 32. For example, when bending a fabric, such as the fabric 10, into the U-shaped cage 16, 15 anvils are used since there are 15 transverse wires to be bent.

When forming the cage 16, the first bend provided is normally to form one of the hooks 20, both of which are usually required to be 3 to 4 inches long. In presently known benders, such as the bender 24, the perpendicular distance from the anvils 30 to the forming bar 36 is much farther than 4 inches and generally is about 9–10 inches or more. This large distance is provided so that the forming bar does not strike the anvils when the wires are being bent more than 90°, for example, when the wires are bent 135° to form the hooks 20. Since the forming bar in presently known benders is farther from the anvil than the 3- to 4-inch length of the hook to be formed, two methods are now used for forming such hooks.

In the first such method, the hooks are formed by extending the ends 12*a* of the transverse wires 12 under the anvils so that the length of wire under the anvil, plus the length on the side of the anvil remote from the forming bar, is sufficient to form such a hook. The hydraulic rams are then actuated to force the forming bar against the wires 12 to make the bend. As is shown in phantom lines in FIG. 3, when such a bend is made the entire fabric 10, with the exception of the 3- to 4-inch hook portion, is forced over the top of the bender. As mentioned above, such fabric may be 20 feet long and can be 5 or more feet wide. Thus, several workers must be positioned on the side of the bender opposite from the forming bar to catch and support the heavy fabric as it is thrown over the top. Providing such extra workers is expensive. Additionally, the weight of the fabric when it is over the top of the bender tends to jam the hooks between the anvil and its associated carrier. This increases the time it takes to remove the hooks from under the anvils for repositioning the fabric for the next bend. Adding time to the bending process increases its cost.

The second hook 20 is formed by the same method used to form the first hook. Thus, the entire wire mesh must be lifted from the machine and turned around so that the ends of the transverse wires opposite the already-formed hooks are under the anvils and facing away from the forming bar. When the fabric has been repositioned, the above sequence is repeated, and again the entire wire fabric, with the exception of the 3- to 4-inch hook being formed, is forced over the top of the bender.

Removing the wire fabric from the machine and turning it around to form the second hook creates several problems. First, it is time-consuming and, thus, inefficient. Additionally when the spacing of the transverse wires is not uniform, it can be necessary to reposition the anvils along the length of the track to accept the fabric. Repositioning of the anvils increases the time of the operation and, thus, increases the cost.

As an alternate to forcing the entire fabric over the bender when forming the hooks, hooks having a length equal to the distance between the forming bar and anvil can be provided, i.e., about 9–10 inches or more. Depending on the size of the U-shaped cage being formed, such 10-inch hooks could, as shown in dashed lines in FIG. 2, close the U along its length. This is undesirable because the rebars 22 must then be placed into the U from above, rather than through the opening along the length of the U. Therefore, the ends of the hooks are cut off to reopen the U. Cutting the hooks is expensive, and, in any event, forming larger hooks than required results in an unnecessary waste of steel.

Although the prior art bender shown in FIG. 3 has only one forming bar assembly, one such bender is known to have been modified to include a second forming bar assembly essentially identical to the first. (The second assembly extends along the side of the machine opposite from the first assembly.) Such a dual forming bar bender (two-arm bender) has the advantage that both hooks can be formed without removing the fabric from the machine and turning the fabric around.

The distance from the anvils to the forming bars in the two-arm bender, however, remains greater than about 9–10 inches. Thus, the presently known two-arm bender has the same problems associated with forming the hooks as were described for the bender shown in FIG. 3. That is, extra workers must be provided to catch the wire fabric as it is forced over the top of the machine.

It is, therefore, desirable to provide to the art an efficient and easy-to-operate fabric bending apparatus on which short (3- to 4-inch) hooks can be bent without forcing the rest of the wire mesh fabric over the top.

SUMMARY OF THE INVENTION

This invention relates to an apparatus and method for bending wire.

The apparatus comprises an anvil having an axis around which a wire is to be bent and means for supporting the wire in contact with the anvil. A plane is defined by the anvil axis and the contact between the wire and anvil. The apparatus includes an arm mounted to pivot with respect to the anvil about a point on one side of the plane, with the arm extending from its pivot point to the other side of the plane. A forming bar is secured to the arm on the side of the plane remote from the pivot. The apparatus also includes means for pivoting the arm to bring the forming bar into contact with the wire and bend it around the anvil.

The method provided in accordance with this invention for bending such a wire is to place the wire under a surface of an anvil having an axis around which the wire is to be bent. The wire is then contacted on one side of a generally vertical plane passing through the anvil axis. The wire contact is pivoted about a point on the other side of the plane for bending the wire around the anvil.

DRAWINGS

These and other features, aspects, and advantages of the present invention will be more fully understood when considered with respect to the following detailed description, appended claims, and accompanying drawings, wherein:

DETAILED DESCRIPTION

Figure 4:
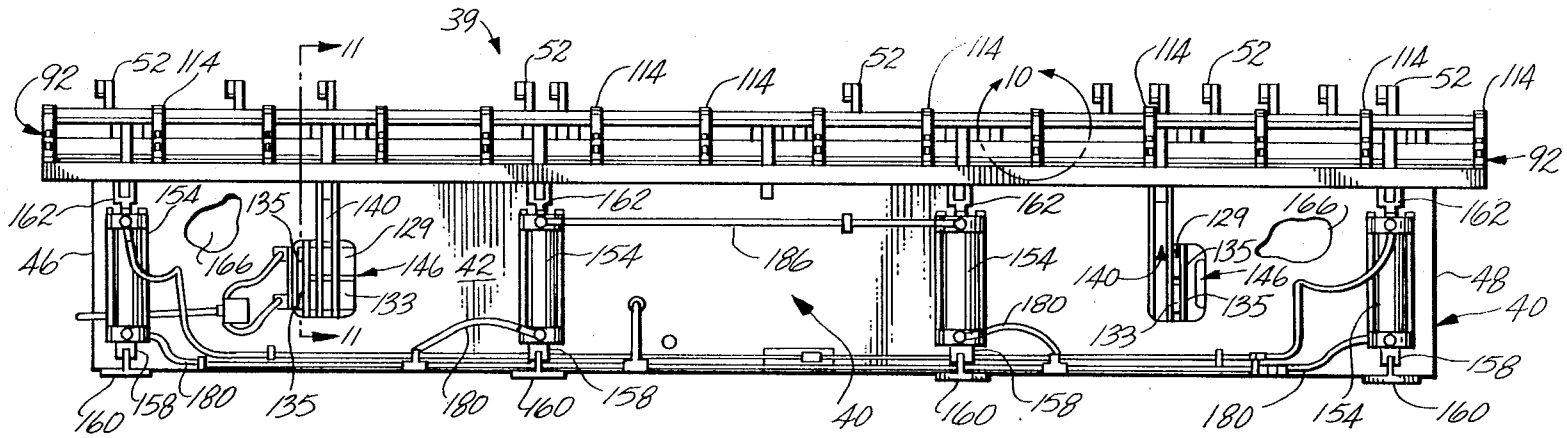
FIG. 4 is a schematic side elevation view of a working embodiment of a wire bending apparatus provided in accordance with practice of this invention.
Figure 5:
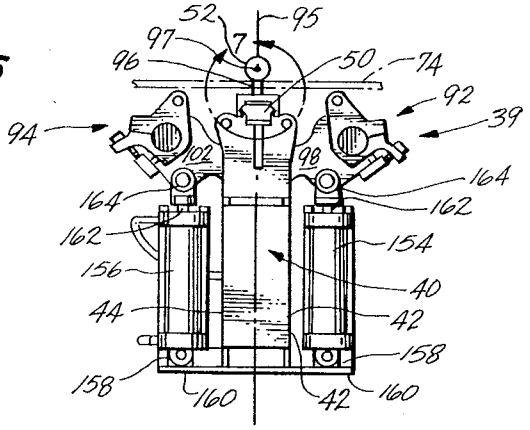
FIG. 5 is a front elevation view of the wire bending apparatus of FIG. 4.
Figure 6:
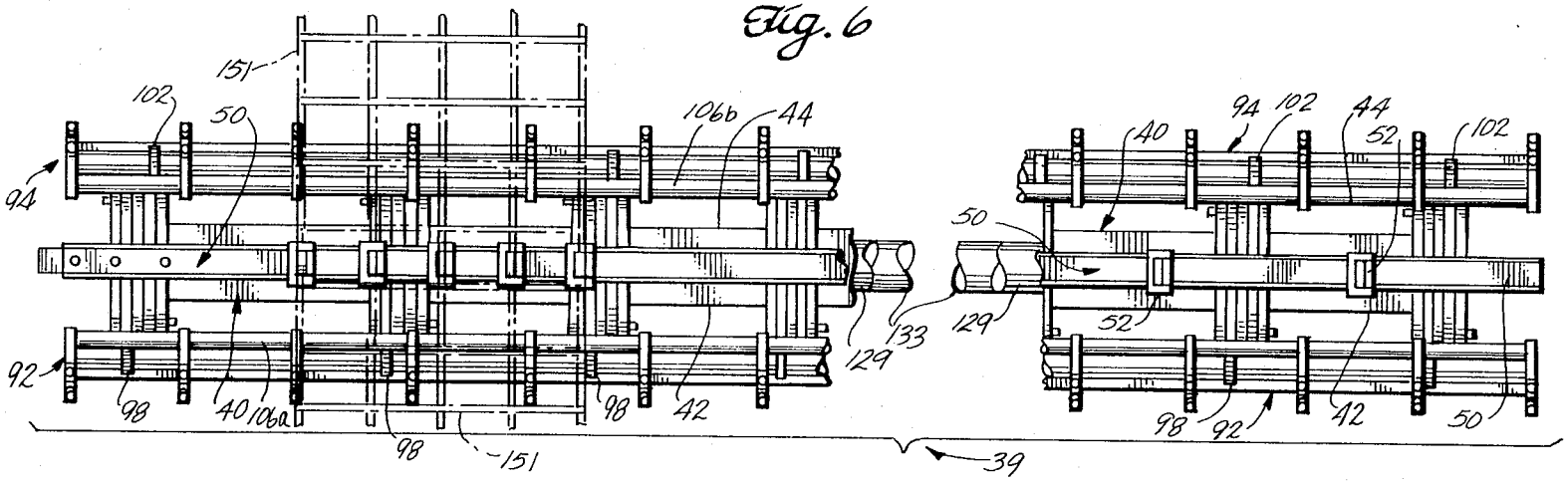
FIG. 6 is a fragmentary top view of the wire bending apparatus of FIG. 4.

Referring to FIGS. 4–6, there are shown schematic side, front, and top views, respectively, of a working embodiment of an apparatus 39 provided in accordance with practice of this invention for bending wire fabric. Although the apparatus or bender 39 can be positioned at various angles during use, it is described below as if it is mounted, as usual, on a flat horizontal surface.

The bender 39 comprises an elongated, generally rectangular frame or support 40. The frame 40 has opposing flat, generally vertical panels 42 and 44 forming its sides and opposing flat, generally vertical panels 46 and 48 forming its front and back ends, respectively. For purposes of exposition herein, the right- and left-hand sides of the bender 39 are defined as if the bender is being viewed from the front. Thus, the side along which the panel 42 extends is the right-hand side, and the side along which the panel 44 extends to the left-hand side.

Mounted on the top of the frame and extending horizontally along the center of its length is an elongated track 50. At least one anvil 52, around which a wire is to be bent, is mounted on the track. As mentioned above, a welded wire fabric comprises a plurality of transverse wires that are preferably bent to a selected angle at the same time. Since each such wire is bent around an associated anvil, the number of anvils on the track used for bending a particular wire fabric is determined by the number of transverse wires comprising that fabric. In FIG. 4, for purposes of illustration, there are 12 anvils on the track.

Figure 7:
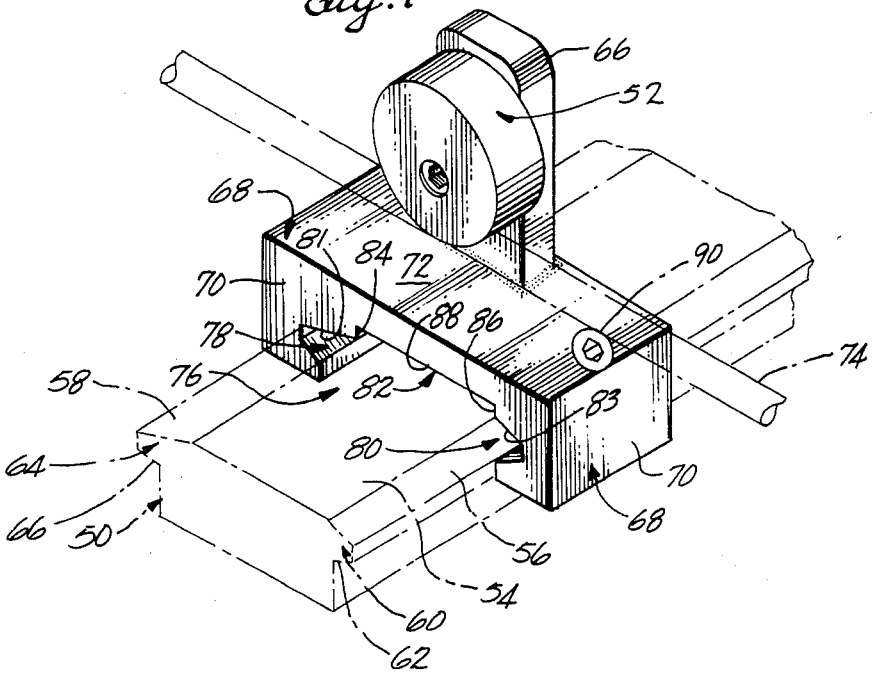
FIG. 7 is an enlarged view of the components enclosed by the circle 7 of FIG. 5.
Figure 8:
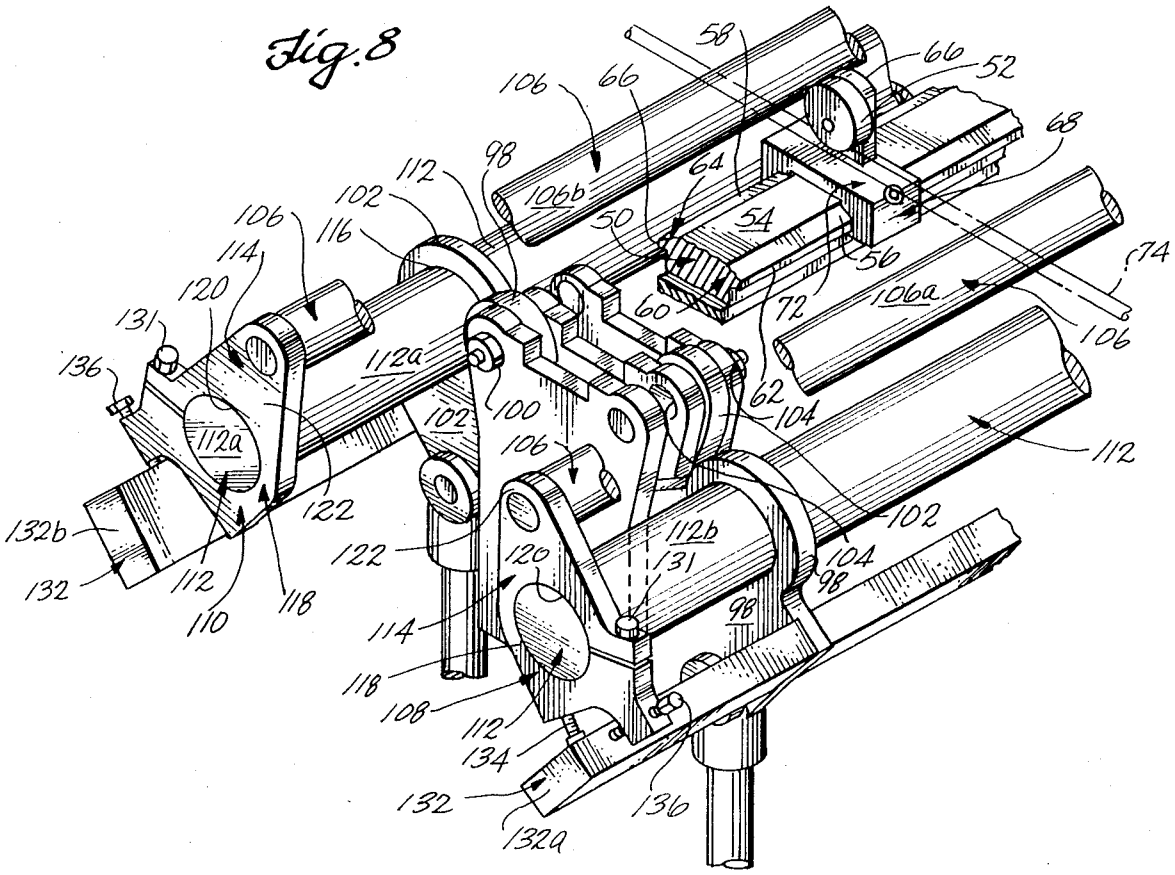
FIG. 8 is a schematic, fragmentary, partially cutaway, perspective view of the bending apparatus of FIG. 4.

A preferred configuration of the anvils 52 and track 50 can best be understood by referring to FIGS. 7 and 8, in addition to FIGS. 4–6.

The track 50 has a flat top surface 54 along its length. Adjacent the surface 54 and extending along the right-hand side of the track is a bevel 56. Adjacent the top surface 54 and extending along the left-hand side of the track is a bevel 58. The bevel surface 56 comprises the top surface of a tapered wing 60 that forms the right-hand side of the track and extends along its length. The bottom surface 62 of the wing 60 is also tapered. The bevel surface 58 comprises the top surface of a tapered wing 64 that forms the left-hand side of the track and extends along its length. The bottom surface 66 of the wing 64 is also tapered.

The anvil 52 is a cylinder that is removably mounted on a vertical arm 66 that, in turn, is fixed to a carrier 68. The axis of the cylindrical anvil is horizontal and parallel to the longitudinal axis of the frame. Although only one side anvil is shown, anvils having different diameters can be mounted on the track, as desired, depending upon the size, i.e., the diameter of the wire being bent. To avoid kinking such wire, the diameter of an anvil used for bending it is generally at least about 4 times the wire diameter.

The carrier 68 has a body portion 70 with a flat top surface 72 facing the bottom surface of the anvil. When a wire such as the wire 74 is to be bent, it is positioned for bending between the top surface 72 of the carrier and the bottom of the cylndrical surface of the anvil.

The carrier 68 also has a cutout portion 76 for engaging the track. The cutout portion comprises a tapered slot 78 on its left side for engaging the wing 64 and a tapered slot 80 on its right-hand side for engaging the wing 60. The top surface 81 of the tapered slot 78 is about parallel to the bevel 58, and the top surface 83 of the tapered slot 80 is about parallel to the bevel 56. The cutout portion also comprises a generally rectangular recess 82 between the slots 78 and 80. The recess comprises two opposed, generally vertical sidewalls 84 and 86 and a generally flat interior surface 88. The sidewall 84 of the recess extends generally vertically upwardly from the inner edge of the top surface 81 of the slot 78, and the sidewall 86 of the recess extends generally vertically upwardly from the inner edge of the top surface 83 of the slot 80. The interior surface 88 of the recess is in parallel-facing relationship to the flat top surface 54 of the track.

Figure 9:
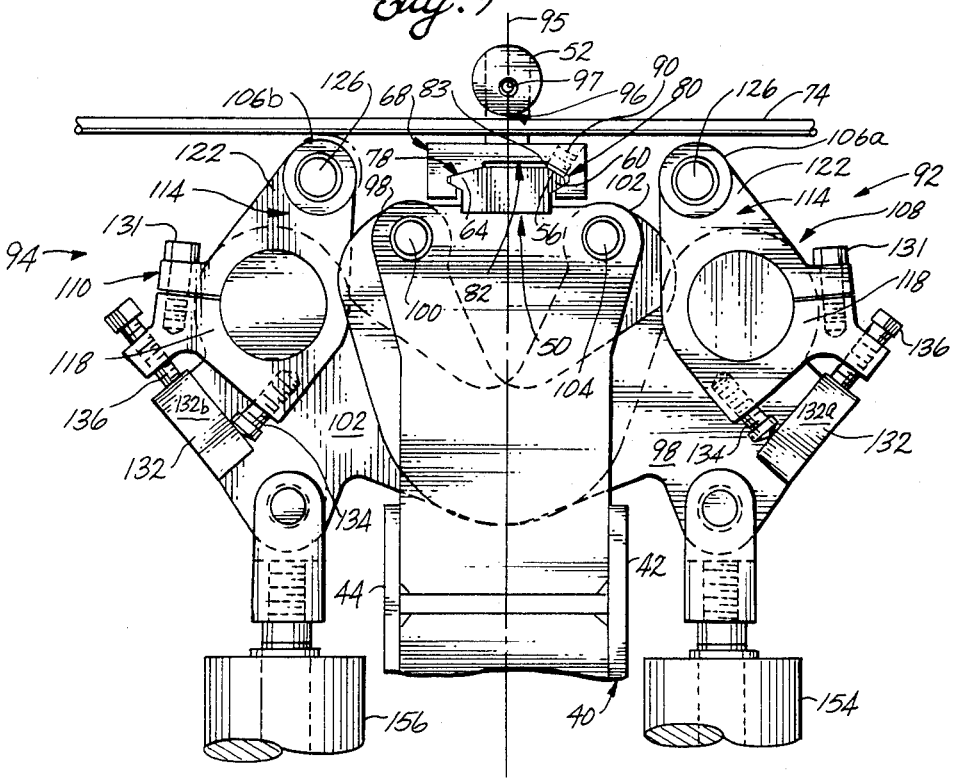
FIG. 9 is a schematic, fragmentary, front elevation view of the bending apparatus of FIG. 4.

As is best seen in FIG. 9, a set screw 90 is through the carrier and extends through the top surface 83 of the tapered slot 80 for engaging the bevel 56 to thereby secure the anvil in its desired position on the track. When the set screw is tightened to its engaged position, it forces the tapered surfaces of the wing 64 firmly against the tapered surfaces of the slot 78. Additionally, the bottom surface of the wing 60 is forced against the bottom surface of the tapered slot 80. Such engagement holds the anvil 52 firmly in position during the wire bending operation.

When the set screw 90 is loosened, the anvil can be easily slid along the track to its next desired position. Ease of sliding is enhanced by the recess 82 because, when such a recess is provided, it reduces the amount of the track surface that is in contact with the surfaces of the carrier, thus reducing sliding friction. Additionally, the configuration of the tapered wings and slots reduces binding of the carrier 68 as it is moved along the track. When a plurality of anvils must be repositioned along a track during a wire fabric bending operation, and such anvils are constructed in accordance with this invention, considerable time is saved. This improves the economics of the wire bending operation.

As can best be seen in FIGS. 5 and 9, a pair of forming bar assemblies 92 and 94 are provided for moving and supporting the wire 74 in contact with the anvil 52 and for bending it around the anvil. An imaginary, generally vertical plane 95 is defined by the anvil axis 97 and the contact 96 between the wire 74 and the anvil. The plane 95 divides the bender 39 into two generally symmetrical halves; a right-hand half or first half extending along its right or first side and a left-hand half or second half extending along its left or second side.

The forming bar assemblies 92 and 94 are pivotally mounted to the frame and extend horizontally along the sides of the frame near its top. The assembly 92 extends along the right side of the apparatus and the assembly 94 along its left side.

The mounting of the forming bar assemblies 92 and 94 on the frame 40 and the construction of the assemblies can best be understood by referring to FIGS. 8 and 9.

The right-hand forming bar assembly 92 comprises a plurality of arms 98 spaced apart along the length of the frame (only one such arm 98 is shown in FIGS. 8 and 9). Each arm 98 is pivotally mounted to the frame on a pin 100 on the left-hand side of the plane 95. The arms 98 extend from their pivots or pins 100 on the left-hand side of the plane 95, across the frame to the right-hand side of the plane.

The left-hand forming bar assembly 94 comprises a plurality of arms 102 spaced apart along the length of the frame (only one such arm 102 is shown in FIGS. 8 and 9). Each arm 102 is pivotally mounted to the frame on a pin 104 on the right-hand side of the plane 95. The arms 102 extend from their pivots or pins 104 on the right-hand side of the plane 95, across the frame to the left-hand side of the plane.

The forming bar assemblies 92 and 94 each include a forming bar 106 secured to its associated arms for contacting and bending the transverse wires of a wire mesh assembly around the anvils. As is described below in detail, such wires can be bent counterclockwise around the anvil using the forming bar **106*a* of the right-hand assembly 92, or can be bent clockwise around the anvils using the forming bar 106*b* of the left-hand assembly 94. Preferably, for example, when bending a wire mesh into the shape shown in FIG. 2**, one or more bends are made using one forming bar assembly, and the remaining bends are made using the other assembly.

The right-hand forming bar **106*a* is secured to the arms 98 by means of a linkage 108, and the left-hand forming bar 106*b* is secured to the arms 102 by means of a linkage 110. Each such linkage comprises an elongated tie bar 112 and a plurality of connecting members 114. As can be seen in FIG. 4, in the working embodiment of the bender 39 there are 14 such connecting members 114 associated with the right-hand forming bar assembly. There are also the same number of connecting members 114 associated with the left-hand forming bar assembly. The tie bars 112 each extend along their respective sides of the frame about parallel to the longitudinal axis of the frame. Each forming bar 106 extends parallel to its associated tie bar, and thus, the forming bars are parallel to each other. Each connecting member 114** is connected between a tie bar and its associated forming bar to maintain the tie bar and forming bar in spaced-apart parallel relationship.

As is best seen in FIG. 8, the left-hand tie bar 112*a* extends through a circular opening 116 in each arm 102 and is permanently connected to the arms by welding or the like. The right-hand tie bar 112*b* is similarly connected to each of the arms 98.

Each connecting member 114 comprises a tie bar clamp section 118 as one end having a circular opening 120 through which its associated tie bar extends. Each connecting member also comprises a forming bar mounting section 122 at its end opposite from the tie bar clamping section 118.

Although the forming bars 106 have been described thus far as solid bars, in a preferred embodiment the forming bars are made up of a plurality of forming bar segments, with each such segment extending between adjacent connecting members.

Figure 10:
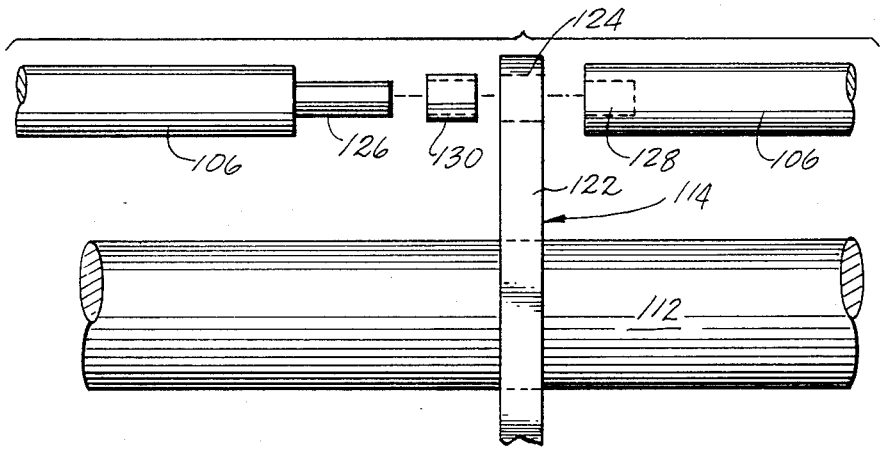
FIG. 10 is an enlarged, fragmentary, exploded view of the components enclosed by the circle 10 of FIG. 4.

The configuration of the forming bars 106 and the mounting sections 122 of the connecting members 114 to which they are attached can be best understood by referring to FIG. 10. The forming bar mounting section 122 of the connecting member 114 comprises a circular opening 124 having an axis parallel to the axis of each forming bar segment 106. Each such segment 106 has a male end 126 that is through the circular opening 124 and extends into a female end 128 of an adjacent section. A hollow sleeve 130 is in the opening 124 to provide a bearing surface for the male end of the forming bar. The male end 126 is slightly smaller in outside diameter than the inside diameter of the female end 128. Thus, each forming bar section is free to rotate about its longitudinal axis independently of the other forming bar sections. Such free rotation reduces the pull on the wires as the forming bar is forced along them during the bending operation. This inhibits the wires from being pulled horizontally under the anvil by the forming bar and, thus, ensures that the bend is made at the desired location on the wires.

Referring again to FIGS. 8 and 9, the diameter of the clamping section 118 of each connecting member 114 is adjustable by means of an adjusting bolt 131 so that the clamping section can be tightened to fix the connecting member 114 in position on the tie bar. Alternatively, the bolt 131 can be loosened so that the connecting member can be rotated around the longitudinal axis of the tie bar 112. Such rotation allows the forming bar 106 to be rotated toward and away from the anvils 52. Thus, the forming bar can be placed a selected distance from the anvils, depending on the size of the anvils used and the size of the wire being bent.

As is described below in greater detail, the distance between such a forming bar 106 and the anvils 52 can be made small enough so that a wire sufficiently short to form a 3-to 4-inch hook can be bent to angles up to about 135° around the anvil. This is made possible by the unique construction of the bender 39 in which, as described above, the pivot points of the arms of the forming bar assemblies are on the opposite side of the bender from the associated forming bars.

As described above, 3- to 4-inch hooks having greater than a 90° bend cannot be formed on prior art benders without forcing the entire fabric over the top of the bender.

Turning again to FIGS. 8 and 9, each forming bar assembly also includes a rail 132 extending along its length. The rail 132*a* associated with the right-hand forming bar assembly is connected to each of the arms 98, and the rail 132*b* associated with the left-hand forming bar assembly is connected to each of the arms 102. Two adjusting screws 134 and 136 are through each connection assembly 114 and can be moved to rotate the connecting members around its associated tie bar when the bolts 131 are loosened. Additionally, the screws help maintain the connecting member in position on the tie bar when the bolts 131 are tightened.

Figure 11:
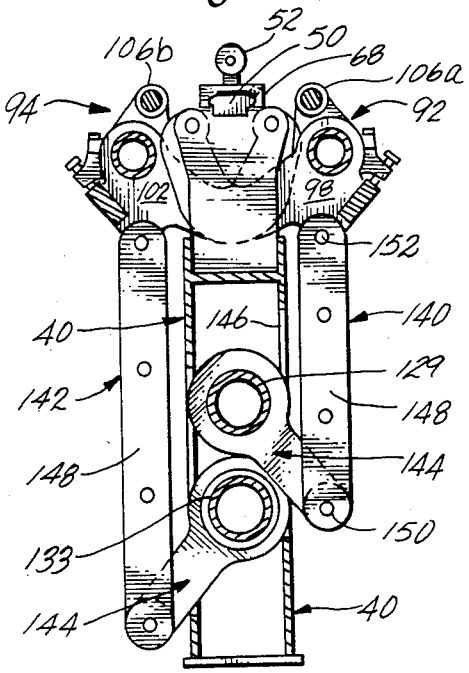
FIG. 11 is a schematic view taken on line 11—11 of FIG. 4.

As can best be seen in FIGS. 4, 6, and 11, a pair of torque tubes 129 and 133 are mounted one above the other in the frame 40 and extend along the length of the frame. Each torque tube is connected at its ends to the frame in bearings 135 and is free to rotate about its longitudinal axis.

The torque tube 129 is connected at both ends by means of linkages 140 to the right-hand forming bar assembly 92. The torque tube 133 is connected at both ends by means of linkages 142 to the left-hand forming bar assembly.

Each such linkage 140 comprises an arm 144 fixed at one end around the tube 129. The other end of the arm 144 extends through a hole 146 in the frame 40 and is pivotally connected at a pivot 150 to the bottom end of a generally vertical arm 148. The axis of the pivot 150 is parallel to the longitudinal axis of the tube 129. The top end of the arm 148 is pivotally connected at a pivot 152 to one of the arms 98 comprising the right-hand forming bar assembly 92. The axis of the pivot 152 is parallel to the axis of the torque tube 129.

Each such linkage 142 also includes arms 144 and 148 that are similarly connected between the torque tube 133 and the arm 102 of the left-hand forming bar assembly 94.

When a forming bar assembly is pivoted to bring its forming bar into contact with the transverse wires of a wire fabric to bend them around their associated anvils, the forces acting on the forming bar may not be equal. For example, when the wire fabric being bent is only long enough to be in contact with the front half of the forming bar, as is the case with the fabric 151 shown in FIG. 6, the rear half of the forming bar assembly will have less downward forces acting on it as it moves up during the bending operation. Thus, the rear half of the assembly will tend to be twisted out of line with the front half. Such twisting of the forming bar assemblies is prevented by their connection to the torque tubes.

For example as the forming bar assembly 92 is pivoted to make a bend, the torque tube 129 is rotated by the linkage 140 about its longitudinal axis. In order for any portion of the right-hand forming bar assembly 92, that extends between the torque tube linkages 140 at its front and rear ends, to be twisted out of horizontal, the tube itself would have to be twisted. This is also the case with the left-hand forming bar assembly and associated torque tube 133.

Figure 12:
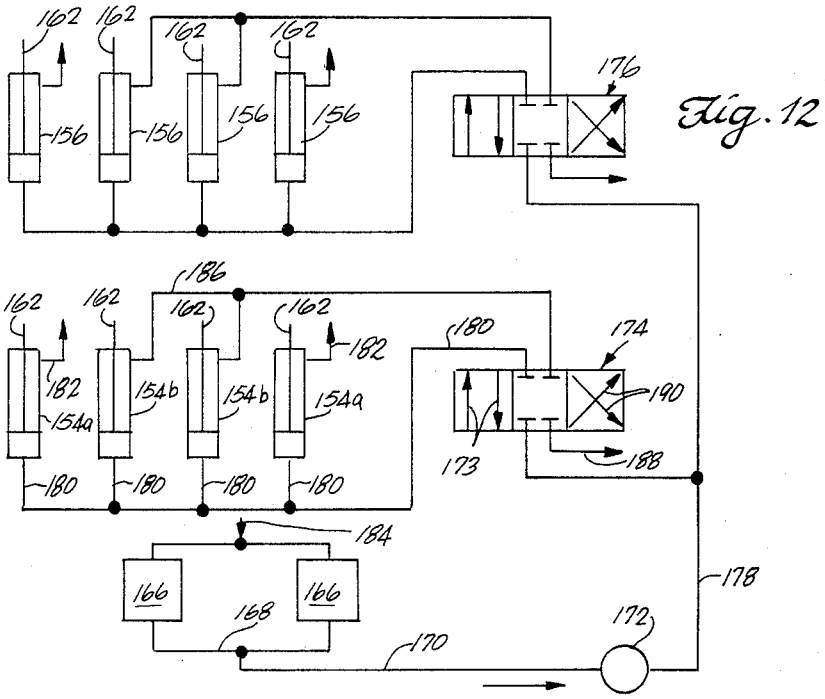
FIG. 12 is a schematic diagram illustrating the operation of a hydraulic system associated with the wire bending apparatus of FIG. 4.

As can best be seen by referring to FIGS. 4, 5, and 12, four hydraulic rams 154 are provided for pivoting the right-hand forming bar assembly 92, and four hydraulic rams 156 are provided for pivoting the left-hand forming bar assembly 94. As best seen in FIG. 4, the four rams 154 are uniformly spaced along the length of the right-hand assembly 92. Although not shown, the four rams 156 are also similarly uniformly spaced along the length of the left-hand assembly 94.

Each such hydraulic ram 154 and 156 is pivotally mounted by means of a clevis 158 at its base to a plate 160 that extends horizontally from the base of the frame 40. A piston rod 162 extends from the top of each ram and is pivotally mounted by means of a clevis 164 to an associated pivot arm of its associated forming bar assembly. The axis of each clevis pin of each such clevis 158 and 164 is parallel to the longitudinal axis of the frame. Thus, the rams can pivot toward and away from the frame.

The hydraulic system is controlled to raise and lower the forming bar assemblies by means of an electrical control circuit than is described in detail below and shown in FIGS. 13 and 14.

The hydraulic system comprises a pair of tanks 166 for hydraulic oil housed in the frame 40 at its ends. The tanks are connected together at their outlets by means of a cross-connect pipe 168, best seen in FIG. 12. The cross-connect pipe 168 is connected by means of pipe 170 to the suction of a pump 172.

Hydraulic fluid is provided to the rams to cause them to pivot up and down by means of a pair of solenoid-operated flow control valves. A first flow control valve 174 is provided to supply and return oil from the rams 154 associated with the right-hand forming bar assembly 92. A second flow control valve 176 is provided to supply and return oil from the rams 156 associated with the left-hand forming bar assembly 94.

When it is desired to raise the right-hand forming bar assembly 92, a spool (not shown) in the valve 174 is shifted by means of the electrical control system to its position for supplying hydraulic fluid to the bottom of the rams 154 to force the piston rods up. When the spool is in its "up" position, flow through the valve 174 is as indicated by the arrows 173. Thus, to raise the piston rods, fluid flows from the pump 172, through the pump outlet pipe 178, into the valve 174. The fluid exits the valve 174 in a line 180 which branches and enters the bottom of each ram 154. This forces the piston rods 162 up to pivot the right-hand forming bar assembly 92. As the pistons move up, fluid that was contained in the rams above the pistons exits the top of the rams and is returned to the tanks. The fluid exits the top of the two end rams 154*a* via the lines 182 and flows into a common return line 184 that branches into both tanks 166. The fluid exits the top of the two center rams 154*b* via the lines 186 which join together to return fluid to the valve 174. The fluid exits the valve 174 via the line 188 which empties into the return line 184 to return the hydraulic fluid to the tanks.

When the right-hand forming bar assembly reaches its desired up position to make the required bend, the electrical control system causes the spool to shift to its "neutral" position. In this position, the spool blocks the flow of hydraulic oil through the valve, and the forming bar assembly 92 is held in place.

When it is desired to move the forming bar assembly 92 back to its original position, i.e., to pivot the assembly down, the spool in the valve 174 is shifted by means of the electrical control circuit for supplying hydraulic fluid to the tops of two of the rams to force the associated pistons down. When the spool is in its "down" position, flow through the valve is as shown by the crossed arrows 190. Hydraulic fluid is pumped by the pump through the line 178 to the valve 174. The fluid exits the valve 174 in line 186 and enters the tops of the two center rams 154*b*. The fluid entering the rams 154*b* pushes the piston rods 162, associated with those rams, down. Since the piston rods 162 associated with the rams 154*a* are connected, as described above, to the forming bar assembly 92, they are driven down as the assembly is returned to its start or down position. Hydraulic fluid exits the bottom of all four rams 154 via the line 180 and is returned to the valve 174. The returning hydraulic fluid exits the valve 174 via the line 188 which empties into the common return line 184.

Directing the hydraulic fluid into the tops of only two of the four rams 154 to lower the forming bar assembly 92 results in the forming bar assembly being lowered in less than about half the time that it takes to raise it. For example, in one exemplary sequence, the forming bar assembly 92 can be raised fully in 7 seconds and returned from that position in less than about 3½ seconds. Lowering the assembly rapidly reduces the overall bending cycle and enhances the economics of the process.

Operation of the portion of the hydraulic system associated with the left-hand forming bar assembly 94 is identical to the operation described above for the right-hand assembly 92; thus it need not be described.

Figure 14:
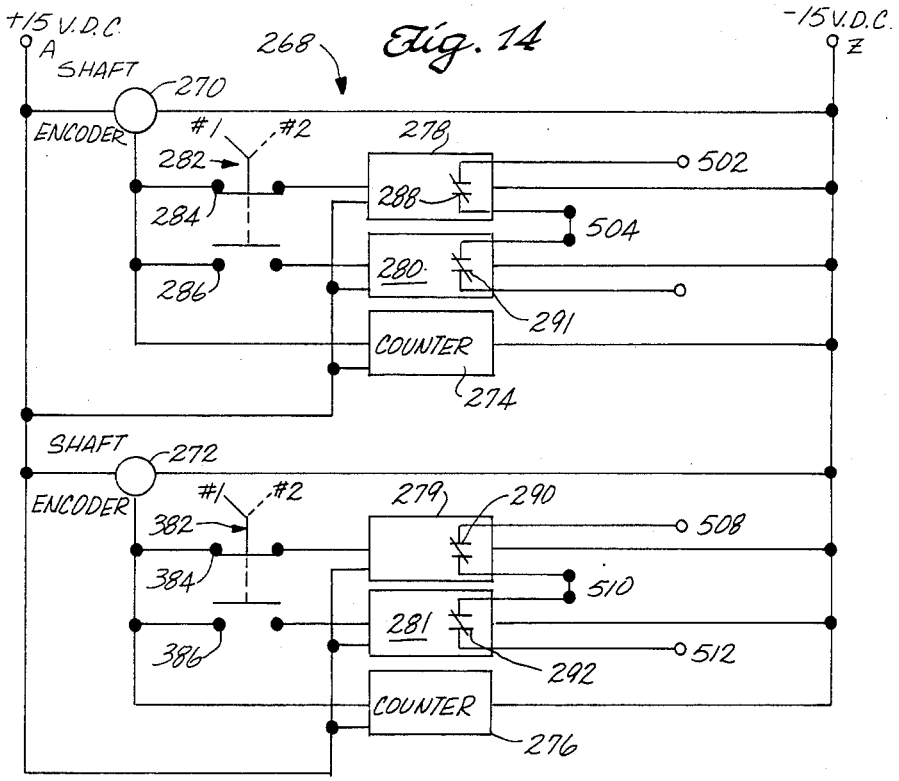
FIG. 14 is an electrical schematic diagram illustrating the operation of a control circuit associated with the electrical circuit of FIG. 13.
Figure 13:
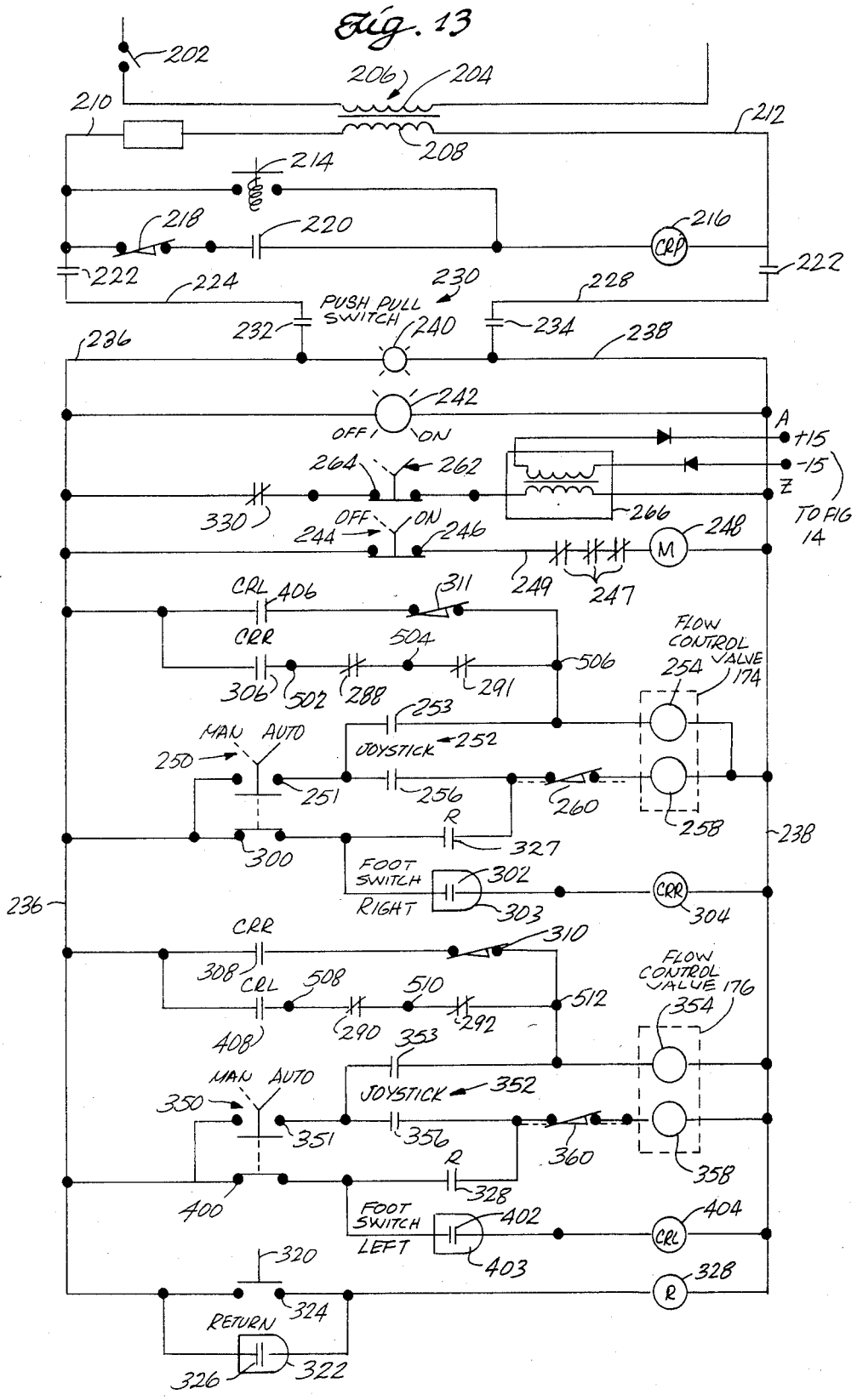
FIG. 13 is an electrical schematic diagram illustrating the operation of the wire bending apparatus of FIG. 4 and its associated hydraulic system.

The operation of the control circuitry for the wire bending apparatus 39 and its associated hydraulic system is understood best by referring to the electrical schematic diagrams of FIGS. 13 and 14.

Operation of the control circuit is initiated by closing a normally open disconnect switch 202 to provide 480 volts A.C. across the primary coil 204 of a step-down transformer 206. The primary coil 204 is coupled to a secondary coil 208 which is connected between conductors 210 and 212 to provide 115 volts A.C. A reset push button 214 is then closed to energize a coil 216 of the control relay CRP. A holding circuit for the coil 216 is completed through a normally closed safety switch 218 and normally open contacts 220 of the control relay CRP. Thus, relay coil 216 remains energized when the reset push button 214 is released.

Energizing the coil 216 of the control relay CRP also closes normally open contacts 222 between the conductor 210 and a conductor 224 and normally open contacts 226 between the conductor 212 and a conductor 228.

Next, a push/pull switch 230 is pushed to close contacts 232 and contacts 234. The contacts 232 are between the conductor 224 and a conductor 236. The contacts 234 are between the conductor 228 and a conductor 238. The remainder of the control circuit is connected between the conductors 236 and 238.

When power is applied across conductors 236 and 238, as described above, a light 240 in the push/pull switch and a light 242 on top of a control panel for the circuit are both lighted.

An off/on switch 244 is turned to its on position to close contacts 246 to energize a motor starting coil 248 for the hydraulic pump 172. Three normally closed overload relay switches 247 are in a conductor 249 between the contacts 246 and the coil 248.

The right- and left-hand forming bar assemblies 92 and 94, respectively, can be operated in two control modes; manual or automatic.

To raise and lower the right-hand assembly 92 in the manual mode, a manual/auto switch 250 is placed in its manual position to close contacts 251. This provides power to the two-way joystick switch 252. To raise the right-hand assembly 92, the joystick is pushed to its up position to close contacts 253. This energizes a solenoid 254 of the hydraulic flow control valve 174 to move its spool to its "up" position for supplying hydraulic fluid to the bottoms of the rams 154. While the joystick 252 is held in its up position, and the contacts 253 remain closed to power the solenoid 254, the assembly 92 is pivoted up. When the joystick is released, it returns to its neutral position, thereby opening the contacts 253 and de-energizing the solenoid 254. The spool of the valve 174 then returns to its neutral position, stopping the motion of the right-hand assembly.

When it is desired to pivot the right-hand assembly 92 back down to its start position, the joystick 252 is pushed down to close contacts 256. This energizes a solenoid 258 of the hydraulic flow control valve 174 to move the spool to its "down" position for supplying hydraulic fluid to the tops of the two center rams **154*b*. While the joystick 252 is held in its down position, and the contacts 256 remain closed, energizing the solenoid 258, the assembly 92** is pivoted down.

A limit switch 260 is in the circuit in series with the solenoid 258. The limit switch 260 is mounted on the bender 39 and can be set to open when the right-hand assembly 92 has been pivoted down to a selected position. When the limit switch 260 opens, the solenoid 258 is de-energized, and the spool of the valve 174 returns to its neutral position, thereby stopping movement of the assembly 92. The limit switch 260 can also be set to allow the assembly 92 to return to its fully lowered position, if desired.

Operation of the circuit for raising and lowering the left-hand forming bar assembly 94 in its manual mode is the same as that described above for the right-hand assembly 92. Components of the circuit provided for manual operation of the left-hand assembly are given the same reference numbers (increased by 100) as their counterpart components described above for manual operation of the right-hand assembly 92.

Travel of both the right- and left-hand forming bar assemblies 92 and 94 can be monitored during the manual mode of operation by turning a switch 262 to its on position. This closes contacts 264 to supply 115 volts A.C. to a rectifier 266 which, in turn, supplies 15 volts D.C. to a counter circuit 268 shown in FIG. 14. Two identical shaft encoders are provided in the counter circuit 268; a right shaft encoder 270 that monitors the movement of the right-hand forming bar assembly 92 and a left shaft encoder 272 that monitors the movement of the left-hand forming bar assembly 94. Shaft encoders, such as those identified as Models 39300 and 39700, supplied by Eton Corporation, Count/Control Systems Division, of Watertown, Wis., can be used.

To detect the movement of the forming bar assembly 92, the right encoder 270 is coupled to the torque tube 131, and the left encoder 272 is coupled to the torque tube 133. As each torque tube rotates during the bending operation, it causes the shaft of the encoder to which it is connected to rotate. As the encoder shaft rotates, the encoder provides a number of pulses proportional to the amount of shaft rotation. The number of pulses can be monitored on counters which provide a readout of the total pulses provided. The distance that the forming bar assembly is rotated can be correlated to the number of pulses recorded.

In the working embodiment, a counter 274 is provided to read out the pulses provided by the shaft encoder 270, and a counter 276 is provided to read out the pulses provided by the encoder 272.

A pair of count controllers 278 and 280 are provided to receive the output signal from the encoder 270. A pair of count controllers 279 and 281 are provided to receive the output signal from the encoder 272. Count controllers, such as those identified by Model No. 43801-400, supplied by Eton Corporation, Count/Control Systems Division, of Watertown, Wis., can be used.

The particular count controller to receive the signal from the encoder 270 is selected by turning a switch 282 to either its No. 1 or No. 2 position. When the switch 282 is in its No. 1 position, contacts 284 are closed, and the count controller 278 receives the output signal from the encoder 270. When the switch is in its No. 2 position, contacts 286 are closed, and the count controller 280 receives the output signal from the associated encoder.

Each count controller can be set by means of dials on its face (not shown) to receive a selected number of pulses from its associated encoder before it is activated. Once the set number of pulses has been received by such a count controller, it causes a contact in the control circuit to be opened, which stops the upward movement of an associated forming bar assembly. For example, when the switch 282 is in its No. 1 position, normally closed contacts 288 associated with the count controller 278 remain closed until the number of pulses received from the encoder 270 reaches the number set on the dials of the controller 278. The count controllers 279, 280, and 281 operate associated normally closed contacts 290, 291, and 292, respectively.

The contacts associated with the count controllers are also shown in FIG. 13, and their operation is described below with respect to the operation of the circuit of FIG. 13 when it is in its automatic mode.

Operation of the control circuit of FIG. 13 in its automatic mode is illustrated below for making a bend with the right-hand forming bar assembly 92.

The switch 262 is placed in its on position, closing contacts 264 to provide 15 volts D.C. to the encoder circuit 268. The selector switch 282 (shown in FIG. 14) is then placed in either its No. 1 or No. 2 positions to provide a signal from the right shaft encoder 270 to either the count controller 278 or the count controller 280. In the exemplary sequence, the No. 1 position is chosen so that the count controller 278 receives the signal from the encoder 270.

The number or encoder pulses correlated with the desired distance of travel of the right-hand forming bar assembly 92 to make the required bend is then set on the dials of the count controller 278.

The manual/auto switch 250 is then placed in the auto position to close the contacts 300, and the manual/auto switch 350 is placed in the auto position to close the contacts 400. The normally open contacts 302 of the foot switch 303 are then closed to energize the coil 304 of the control relay CRR. Energizing the coil 304 of the control relay CRR closes normally open contacts 306 in the circuit for the right-hand forming bar assembly 92. The normally closed contacts 288 and 291, operated by the count controllers 278 and 280, are in their normally closed position. Thus, the solenoid 254 of the flow control valve 174 is energized for shifting its spool to its up position. As was described above for manual mode operation of the circuit, this causes the right-hand forming bar to pivot up.

Additionally, energizing the coil 304 of the control relay CRR also closes normally open contacts 308 in the circuit for the left-hand forming bar assembly 94. A limit switch 310 is in the circuit between the contacts 308 and the solenoid 354 of the flow control valve 174. The limit switch 310 is operated by means of a cam associated with the torque tube 133 of the left-hand forming bar assembly 94. At the start of the bending operation, the limit switch 310 is closed, thus, the solenoid 354 is energized. This shifts the spool in the flow control valve 174 to its up position to cause hydraulic fluid to be pumped to the bottoms of the rams 156 to pivot the left-hand forming bar assembly up. The limit switch 310 is set so that when the left-hand forming bar reaches a desired position, it opens by means of the cam turned by the torque tube 133, thereby de-energizing the solenoid 354 and stopping movement of the left-hand forming bar assembly. The desired amount of movement of the left-hand forming bar assembly, when forming a bend with the right-hand assembly, is that amount sufficient so that the forming bar **106*b* (left side forming bar) contacts the wire and bends it an amount required to compensate for "springback". The term "springback", as used herein, is the amount a wire will unbend after it is released by the forming bars. For example, if it is desired to bend a wire 90°, and the wire will unbend or spring back about 10° after it is released, the bend position limit switch 310 can be set so that the left-hand forming bar assembly 94** will bend the wire 10°, while the right-hand forming bar assembly provides the remaining 90°.

A limit switch 311 that operates for the right-hand forming bar assembly the same as the switch 310 operates for the left-hand assembly is operated by means of a cam associated with the torque tube 131.

While the contacts 302 in the foot switch 303 remain closed, the right-hand forming bar assembly 92 will continue to be pivoted up. Pivoting of the assembly continues until the number of pulses provided by the encoder 270 equals the number of pulses set on the count controller 278. When this set point is reached, the contacts 288 open, thereby de-energizing the solenoid 254. This shifts the spool of the valve 174 back to its neutral position, and movement of the right-hand forming bar assembly 92 is stopped.

To return the forming bar assemblies 92 and 94 to their start positions, a return push button 320 or, alternatively, a return foot switch 322, is pushed. The normally open contacts 324 of the push button are in parallel with the normally open contacts 326 foot switch. When either the contacts 324 or 326 are closed, a coil 328 of control relay R is energized. When the coil R is energized, it closes contacts 327 in the circuit of the right-hand forming bar assembly 92 and contacts 328 in the circuit of the left-hand forming bar assembly 94. This energizes the solenoid 258 of the flow control valve 174 and the solenoid 358 of the flow control valve 176. As was described above for the control circuit's manual mode operation, when the solenoids 258 and 358 are energized, the hydraulic system functions to return the forming bar assemblies 92 and 94 to their start positions. The limit switches 260 and 360 can be set as desired to limit the downward movement of the assemblies 92 and 94 respectively.

Energizing the coil 328 of the relay control R also opens normally closed contacts 330 which cuts off power to the counter circuit 268.

The operation of the control circuit in its automatic mode is described above for using the right-hand forming bar assembly 92 to make a desired bend. If desired, such a bend can also be made with the left-hand assembly 94. When making a bend with the left-hand assembly, a foot switch 403 is pushed to close the contacts 402, thereby energizing a coil 404 of a control relay CRL. This closes normally open contacts 406 and 408.

From this point the operation of the circuit to control the left-hand forming bar assembly 94 is obvious by referring to the above description of the operation of the circuit for controlling the right-hand assembly.

Figure 3:
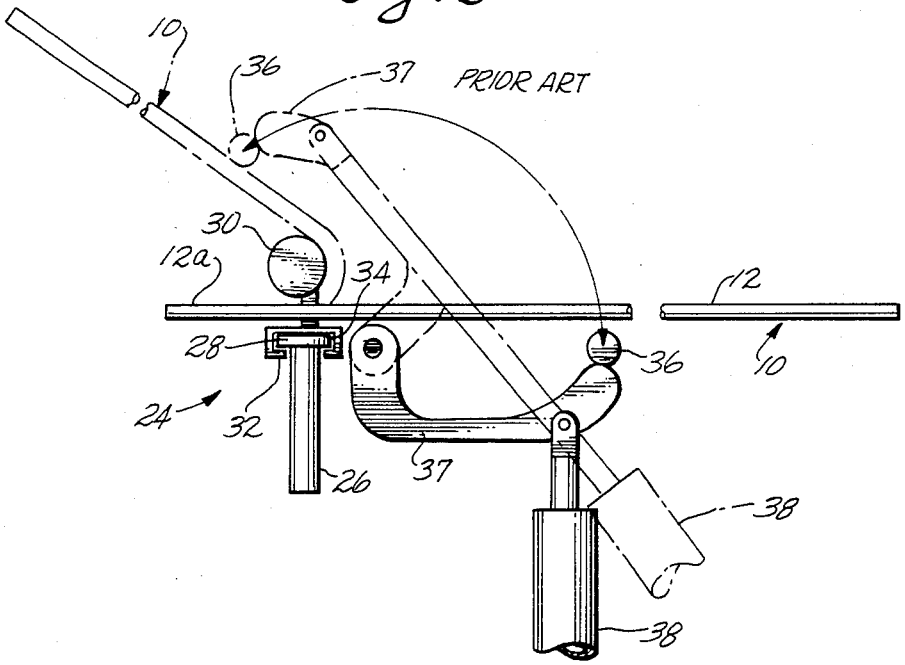
FIG. 3 is a schematic elevation of a prior art apparatus for bending welded wire fabric.
Figure 1:
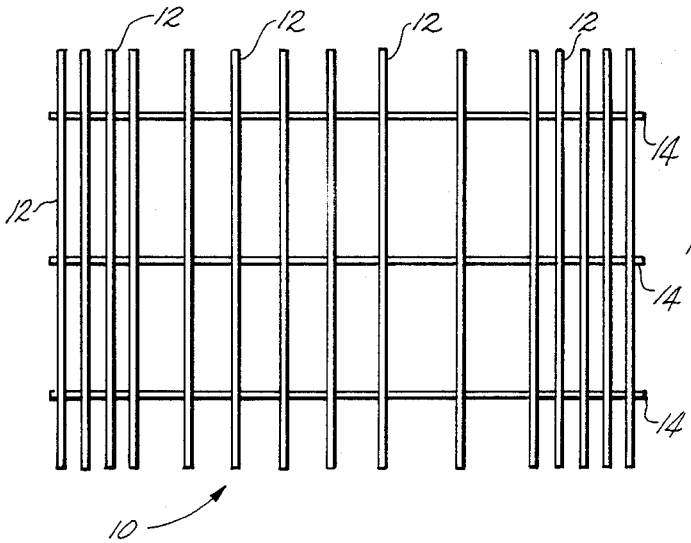
FIG. 1 is a plan view of a welded wire fabric provided to be bent into a desired shape for use in reinforcing concrete.
Figure 2:
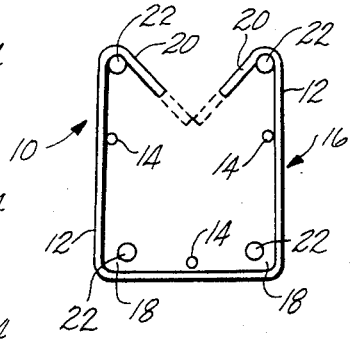
FIG. 2 is an end view of the wire fabric shown in FIG. 1 after it has been bent.

Referring to FIGS. 15–18, operation of the apparatus 39 provided in accordance with this invention for bending a wire fabric, such as the wire fabric 10 shown in FIG. 1, into a U-shaped cage 16, as shown in FIG. 2, can be understood.

Figure 15:
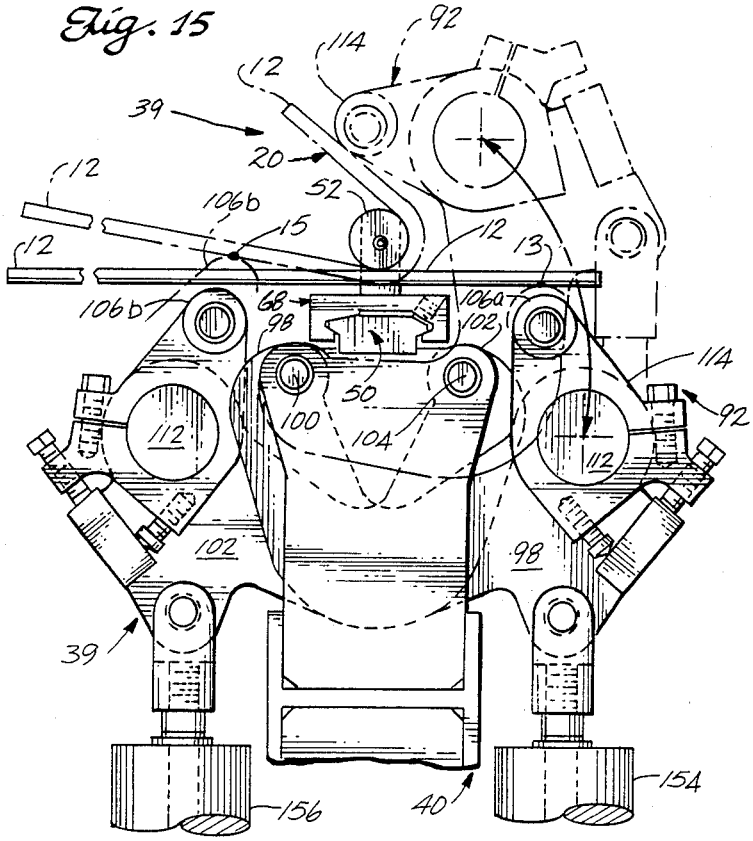
FIG. 15 is a schematic, fragmentary, front elevation view illustrating the operation of the wire bending apparatus of FIG. 4 at one stage of a wire bending operation.

The first bend typically provided is for forming one of the hooks 20. Referring particularly to FIG. 15, the first hook 20 is formed by the right-hand forming bar assembly 92 with the control circuit described above in its automatic mode. The mesh 10 is placed on the apparatus 39 with the transverse wires 12 positioned between the bottom surfaces of the anvils 52 and the top surfaces of the carriers 68. In FIG. 15, only one such anvil 52 and wire 12 are shown. The portion of the transverse wires 12 to be bent into the hook extends from under the anvils 52 to the right-hand forming bar **106*a***.

In this example, the hook is 3 to 4 inches long and is bent 135°. The limit switch 310 for stopping the upward motion of the left-hand forming bar assembly 94 is adjusted to provide for springback. Additionally, counter 278 is selected and set, as described above, to allow the right-hand forming bar assembly 92 to be pivoted up to a desired position to make the 135° bend. Alternatively, if desired, the counter 280 can be selected.

The right foot switch 303 is then pressed to start the bending sequence, and both the right- and left-hand forming bar assemblies 92 and 94 are pivoted up, as is shown in the phantom lines. The right-hand forming bar **106*a* contacts the wire 12 at a point 13 and pivots the wire contact about the pivot pin 100 for bending the wire counterclockwise around the anvil. The left-hand forming bar 106*b* contacts the wire 12 at a point 15 and pivots the wire contact about the pivot pin 104 for bending the wire around the anvil. In this example sequence, the contact 13 is pivoted about 135° counterclockwise to form the hook, while the contact 15 is pivoted about 10° or so to provide for springback. As is described above, the control circuit automatically stops the upward movement of the assemblies 92 and 94** when the required bend has been made.

Once the bend is made, the foot switch 303 is released, and either the return push button 320 or return foot switch 322 is pressed to pivot the forming bar assemblies back to their start positions.

Figure 16:
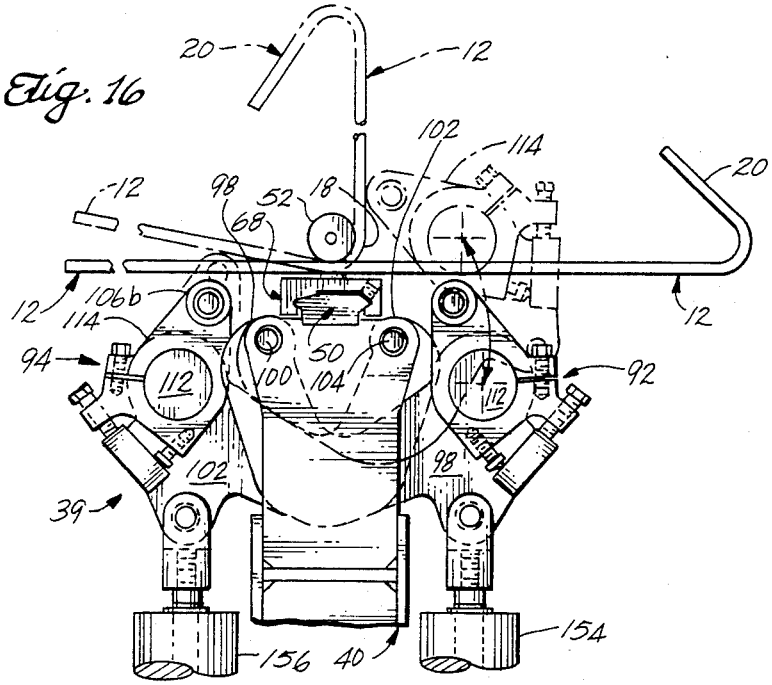
FIG. 16 shows the apparatus of FIG. 15 at another stage of the wire bending operation.

Referring now to FIG. 16, the wire fabric 10 is shown repositioned on the apparatus 39 for making one of the 90° bends 18 in the cage 16. In this case, the 90° bend is made by the right-hand forming bar assembly 92. The count controller 280 can be selected and set to control the assembly 92 to make the 90° bend.

The right foot switch 303 is then pushed, and both the left- and right-hand forming bar assemblies 92 and 94, respectively, move up to their set positions. As was the case when making the hook, as described with reference to FIG. 15, the left-hand forming bar assembly 94 pivots up to provide for springback until the limit switch 310 opens and its movement is stopped. The right-hand forming bar assembly 92 continues to be pivoted up until the set point on the count controller 280 is reached. After both the right and left assemblies have stopped, the foot switch 303 is released, and the assemblies are returned, as before, to their start positions.

Figure 17:
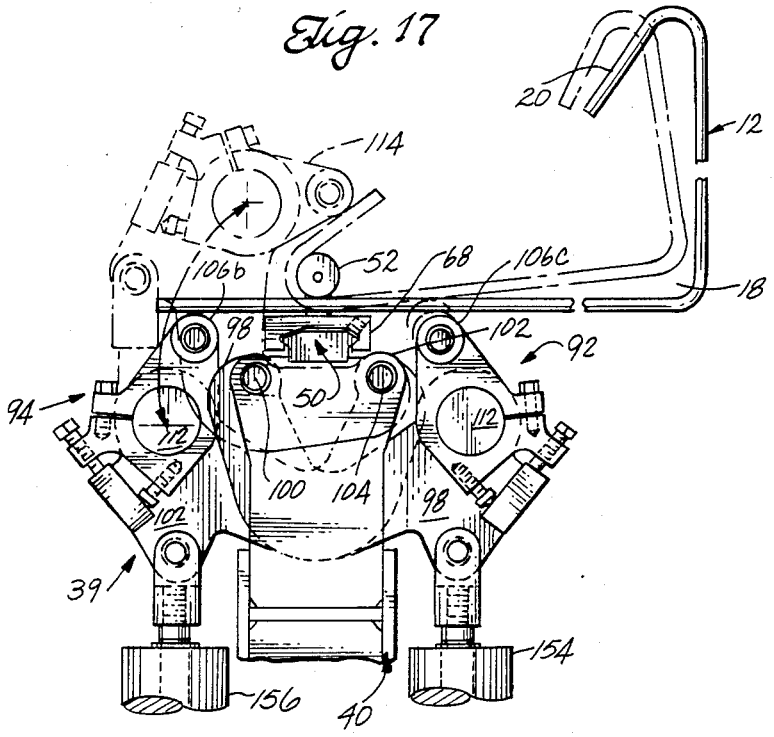
FIG. 17 shows the apparatus of FIG. 15 at another stage of the wire bending operation.

Referring to FIG. 17, the next bend is for forming the second hook 20. The wire fabric is positioned on the apparatus 39 for making the second hook with the left-hand forming bar assembly 94. Because the left-hand assembly 94 is used for making the second hook, the fabric need not be lifted from the apparatus and turned around.

When using the assembly 94, the count controller 279 in the circuit with the encoder 272 is selected, and the set point is dialed in to provide for sufficient pivoting of the left-hand forming bar assembly 94 to form the 135° bend of the hook. (If desired, the count controller 281 can be selected and set.) The limit switch 311 coupled to the torque tube 131 is set to provide for sufficient movement of the right-hand forming bar assembly 92 to provide for springback.

The foot switch 403, associated with the control circuit of the left-hand assembly 94, is then pressed, and both the left- and right-hand forming bar assemblies 92 and 94 are pivoted up to their selected positions for forming the hook 20. The assemblies are returned to their start positions after the bend has been completed.

Figure 18:
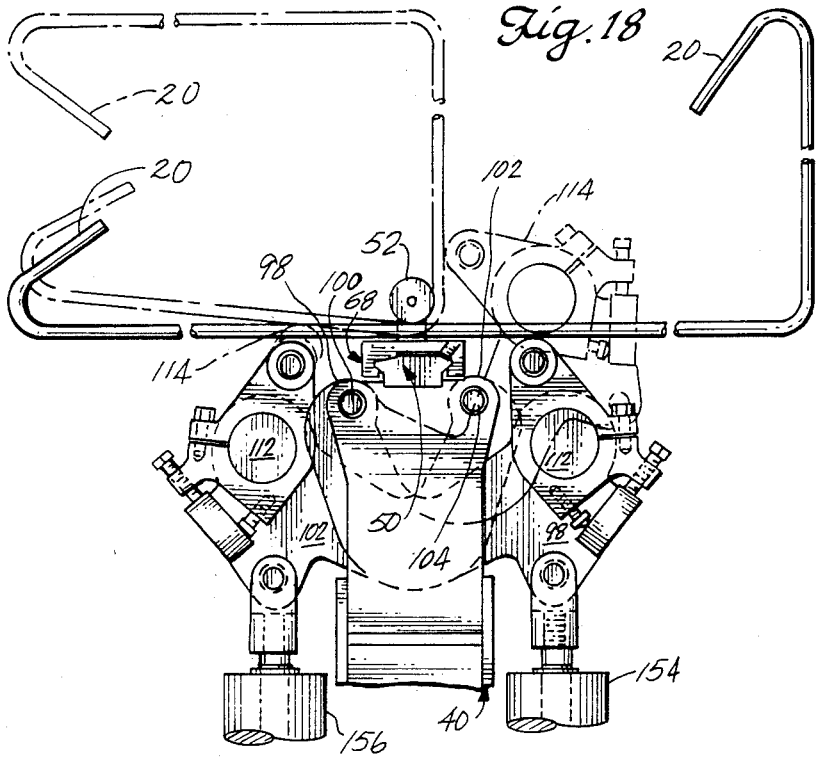
FIG. 18 shows the apparatus of FIG. 15 at yet another stage of the wire bending operation.

Referring to FIG. 18, the wire fabric 10 is next positioned on the apparatus 39 for making the second 90° bend with the right-hand forming bar assembly 92. In this case, the counter 280 can again be selected, since it was previously set to make a 90° bend. Alternatively, if desired, the left-hand forming bar assembly 94 can be used to make the bend.

The right foot switch 303 is pressed, and the forming bar assemblies are pivoted up as before when making the first 90° bend. The forming bar assemblies 92 and 94 are then returned to their start positions, and the formed U-shaped cage 16 is removed from the bender.

By providing the apparatus 39 in accordance with this invention, both of the hooks 20 can be formed without removing the wire fabric from the bender and turning it around. Additionally, even though both hooks are only 3–4 inches long, they are formed without throwing the entire wire fabric over the top of the machine. This eliminates the need for the several workers that are required to catch and support the fabric as it is pushed over the top of the prior art benders when forming such short hooks. Thus, the bender 39 results in a substantially less expensive bending operation.

The above description of a preferred embodiment of a wire-bending apparatus 39 and associated hydraulic and electrical control systems is for illustrative purposes. Because of variations which will be apparent to those skilled in the art, the present invention is not intended to be limited to the embodiment described above. The scope of the invention is defined in the following claims.

What is claimed is:

1. Apparatus for bending wire, the apparatus comprising:

(a) an elongated support;

(b) a track mounted on the top of the support and extending along the length of the support;

(c) at least one anvil mounted on the track, such an anvil having an axis and around which a wire is to be bent, the anvil axis and longitudinal axis of the support defining a plane that divides the support into two generally symmetrical halves;

(d) a pair of forming bar assemblies wherein:

(i) the first such forming bar assembly comprises:

(a) a plurality of arms wherein each such arm is pivotally mounted to the support on a first side of the plane and extends to the second side of the plane; and (b) an elongated forming bar secured to the arms on the second side of the plane; and (ii) the second such forming bar assembly comprises:

(a) a plurality of arms wherein each such arm is pivotally mounted to the support on the second side of the plane and extends to the first side of the plane; and (b) an elongated forming bar secured to the arms on the first side of the plane; and (e) means on the elongated support for pivoting the arms of each forming bar assembly with respect to the anvil to thereby bring such a forming bar into contact with the wire and bend it around the anvil wherein each such forming bar assembly additionally comprises a torque tube for distributing forces provided by the arm pivoting means generally evenly along the length of such a forming bar so that the longitudinal axis of the forming bar remains about parallel to the longitudinal axis of the support when the forming bar is bending the wire around the anvil, wherein each such torque tube extends along the length of the support, is free to rotate about its longitudinal axis, and is connected at each end to a pivot arm of its respective forming bar assembly.

2. Apparatus according to claim 1 wherein each such torque tube is mounted in the support and extends parallel to the longitudinal axis of the support.

* * * * *